US010550685B2

(12) United States Patent
Kalevo et al.

(10) Patent No.: US 10,550,685 B2
(45) Date of Patent: Feb. 4, 2020

(54) COMPONENT FOR ROCK BREAKING SYSTEM

(71) Applicant: SANDVIK MINING AND CONSTRUCTION OY, Tampere (FI)

(72) Inventors: Noora Kalevo, Tampere (FI); Vesa Uitto, Tampere (FI); Tuomo Pirinen, Tampere (FI); Antti Koskimaki, Tampere (FI)

(73) Assignee: Sandvik Mining and Constuction Oy, Tampere (FI)

( * ) Notice: Subject to any disclaimer, the term of this patent is extended or adjusted under 35 U.S.C. 154(b) by 267 days.

(21) Appl. No.: 15/643,098

(22) Filed: Jul. 6, 2017

(65) Prior Publication Data

US 2018/0010439 A1 Jan. 11, 2018

(30) Foreign Application Priority Data

Jul. 7, 2016 (EP) ..... 16178367

(51) Int. Cl.

| | |
|---|---|
| ***E21B 1/00*** | (2006.01) |
| ***E21B 47/00*** | (2012.01) |
| *E21B 6/02* | (2006.01) |
| *E21B 7/02* | (2006.01) |

(52) U.S. Cl.

CPC ..... *E21B 47/0006* (2013.01); *E21B 1/00* (2013.01); *E21B 6/02* (2013.01); *E21B 7/02* (2013.01)

(58) Field of Classification Search

CPC ..... E21B 7/025; E21B 1/00

See application file for complete search history.

(56) References Cited

U.S. PATENT DOCUMENTS

| | | | | |
|---|---|---|---|---|
| 2,766,929 | A | 10/1956 | Rusch et al. | |
| 4,671,366 | A | 6/1987 | Vesa et al. | |
| 6,356,077 | B1 | 3/2002 | Schaer et al. | |
| 7,538,650 | B2 * | 5/2009 | Stenerson | H01F 13/003 335/284 |
| 7,656,161 | B2 * | 2/2010 | McElhinney | E21B 47/02216 324/346 |
| 8,026,722 | B2 * | 9/2011 | McElhinney | E21B 47/02216 324/346 |
| 2012/0313632 | A1 | 12/2012 | Martin et al. | |
| 2014/0332278 | A1 * | 11/2014 | West | E21B 6/04 175/57 |
| 2016/0109612 | A1 | 4/2016 | Hurlimann et al. | |
| 2016/0170070 | A1 | 6/2016 | Jachmann et al. | |

FOREIGN PATENT DOCUMENTS

| | | |
|---|---|---|
| CL | 199901155 | 6/1999 |
| CL | 200501633 | 6/2005 |
| CL | 200502469 | 9/2005 |
| CN | 104236762 A | 12/2014 |
| CN | 104793264 A | 7/2015 |

(Continued)

*Primary Examiner* — Catherine Loikith

(74) *Attorney, Agent, or Firm* — Corinne R. Gorski

(57) ABSTRACT

A component for a rock breaking system is magnetized into a state of remanent magnetization. The remanent magnetization of the component has a predetermined varying magnetization profile relative to geometry of the component, the varying magnetization profile describing varying magnetization intensity in the component relative to the geometry of the component.

16 Claims, 4 Drawing Sheets

(56) References Cited

FOREIGN PATENT DOCUMENTS

| | | | |
|---|---|---|---|
| DE | 19932838 | A1 | 1/2001 |
| EP | 0753602 | A1 | 1/1997 |
| EP | 2811110 | A1 | 12/2014 |
| FI | 69680 | B | 11/1985 |
| JP | 2004264176 | A | 10/1990 |

* cited by examiner

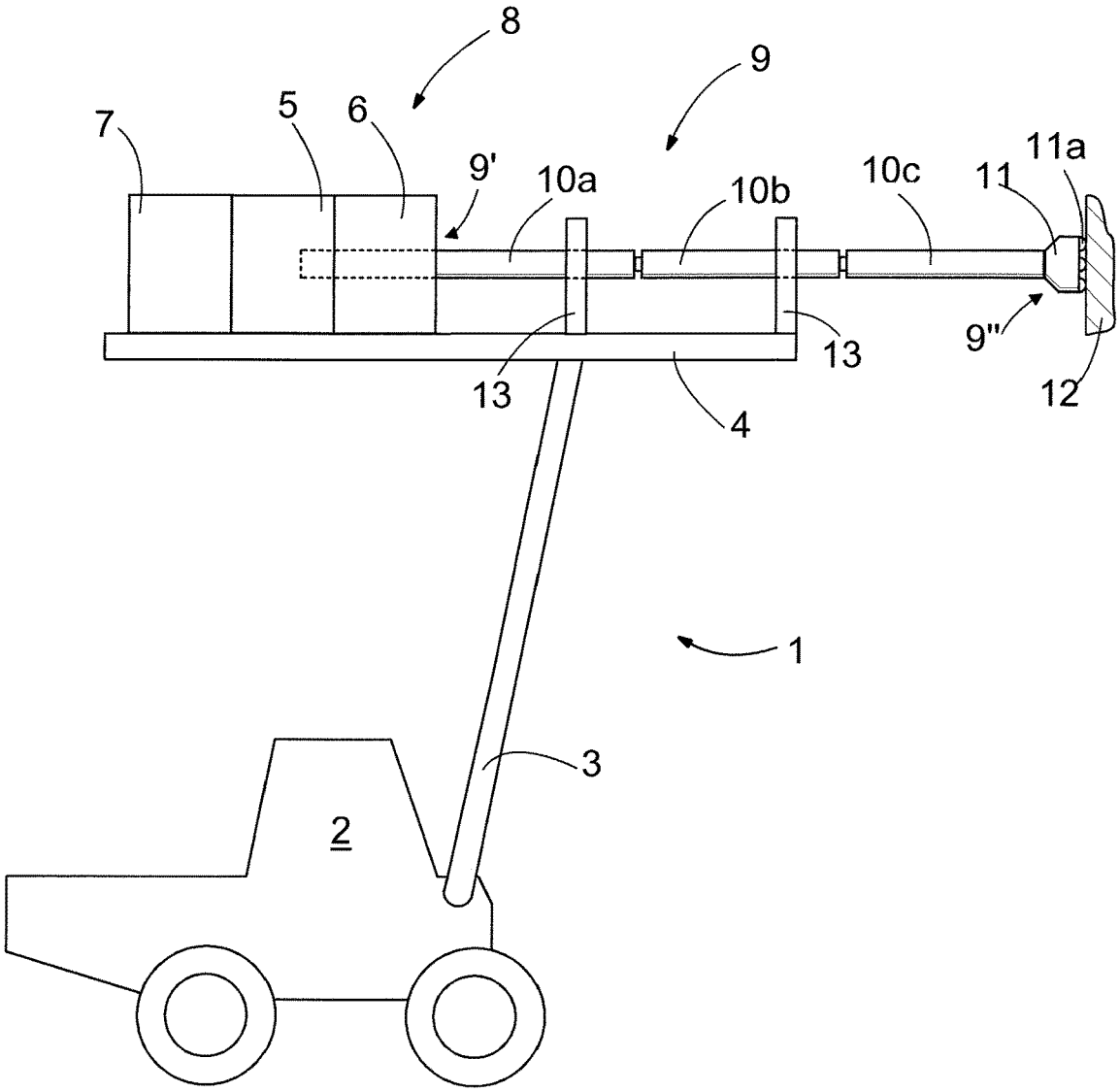
FIG. 1
FIG. 2
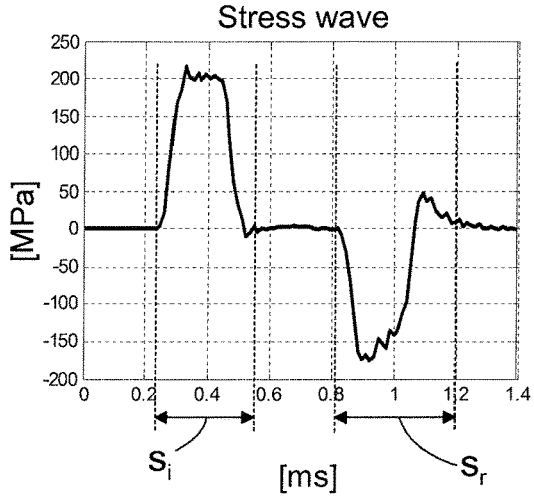

COMPONENT FOR ROCK BREAKING SYSTEM

RELATED APPLICATION DATA

This application claims priority under 35 U.S.C. § 119 to EP Patent Application No. 16178367.5, filed on Jul. 7, 2016, which the entirety thereof is incorporated herein by reference.

TECHNICAL FIELD

The disclosure relates to a component for a rock breaking system, which component is part of the rock breaking system, but which component may also be applied in measurement of stresses, vibrations or forces appearing during rock breaking in the rock breaking system.

BACKGROUND

Stresses appearing during rock breaking in a rock breaking system may be measured and employed in controlling the rock breaking. FI69680 and U.S. Pat. No. 4,671,366 disclose an example of measuring stress waves appearing during rock breaking and employing the measured stress waves in controlling the operation of a rock breaking device. DE19932838 and U.S. Pat. No. 6,356,077 disclose a signal processing method and device for determining a parameter of a stress wave by measuring magnetoelastic changes caused by stress waves in a component of the rock breaking system subjected to percussive loads.

For example, in U.S. Pat. No. 6,356,077 the stress waves appearing during rock breaking are measured by measuring changes in a magnetic property of the rock breaking system component. For the measurement of the stress waves the rock breaking system component is subjected to an external magnetic field by a magnetizing coil simultaneously during the measurement of the stress waves. Subjecting the rock breaking system component to the external magnetic field simultaneously with the measurement of the stress waves will, however, cause disturbances in the measurement results regardless of the instrumentation configuration.

In EP-publication 2811110 at least part of the component of the rock breaking system component is arranged into a state of persistent or remanent magnetization. With this solution the above mentioned problems relating to the simultaneous magnetizing of the rock breaking system component and measurement of the stress waves may be avoided. The arrangement of the rock breaking system component into the state of persistent or remanent magnetization does not necessarily as such provide accurate stress wave measurement results, or results accurate enough to be used for monitoring or controlling the operation of the rock breaking device.

SUMMARY

To overcome the above disadvantages, the present disclosure is directed to a novel solution which may be applied for measurement of stresses, vibrations or forces appearing during rock breaking.

A component for a rock breaking system is magnetized into a state of remanent magnetization, wherein the remanent magnetization of the component has a predetermined varying magnetization profile in at least one of a longitudinal direction, a radial direction, a rotational direction, a direction transversal to a longitudinal direction, a circular direction, and a circumferential direction of the component, the varying magnetization profile describing a varying magnetization intensity in the component relative to the geometry of the component.

When the component of the rock breaking system, at which the magnetoelastic changes caused by the stress waves are measured, is arranged into a state of remanent magnetization, the rock breaking system does not need to be provided with any kind of instruments providing the specific component into a specific magnetic state or instruments subjecting the specific component to an external magnetic field simultaneously during the measurement of the stress waves. This simplifies the instrumentation for the stress wave measurement and does not cause disturbances originating from the instruments providing the specific component into the magnetic state simultaneously during the measurement of the stress waves.

Furthermore, when the state of the remanent magnetization of the component has a predetermined varying magnetization profile relative to a geometry of the component, which varying magnetization profile describes a varying magnetization intensity in the component relative to the geometry of the component, the predetermined varying magnetization profile may be arranged to include specific portions, such as a global peak or local peaks, at which the magnetoelastic changes of the component caused by stress waves are the most detectable or have other desired properties for purposes of the measurement or the use of the component. This increases the measurement accuracy further when the at least one sensor for the measurement of the magnetoelastic changes is arranged at the peak point.

The foregoing summary, as well as the following detailed description of the embodiments, will be better understood when read in conjunction with the appended drawings. It should be understood that the embodiments depicted are not limited to the precise arrangements and instrumentalities shown.

BRIEF DESCRIPTION OF THE DRAWINGS

FIG. 1 is a schematic side view of a rock drilling rig according to the present disclosure.

FIG. 2 shows graphically a stress wave appearing in rock drilling.

For the sake of clarity, the figures show some embodiments of the invention in a simplified manner. In the figures, like reference numerals identify like elements.

DETAILED DESCRIPTION

Figure 3:
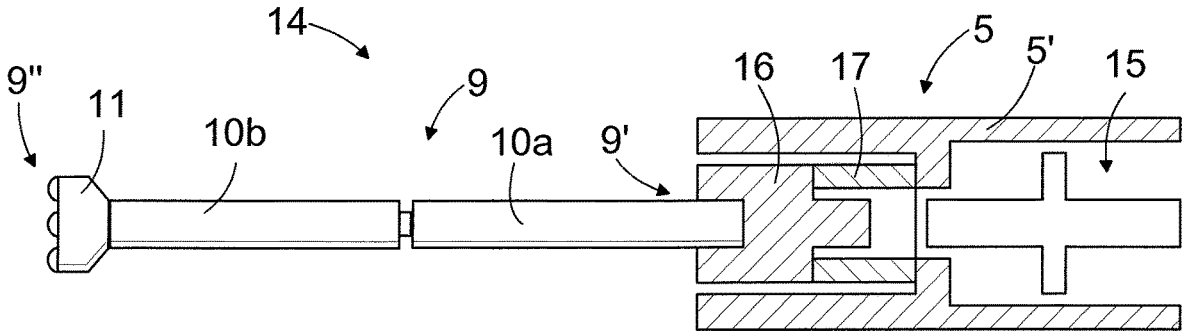
FIG. 3 is a partial cross-sectional side view of a rock breaking system according to the present disclosure.

Rock breaking may be performed by drilling holes in a rock by a rock drilling machine. Alternatively, rock may be broken by a breaking hammer. In this context, the term "rock" is to be understood broadly to cover also a boulder, rock material, crust and other relatively hard material. The rock drilling machine and breaking hammer include an impact mechanism, which provides impact pulses to the tool either directly or through an adapter. The impact pulse generates a stress wave which propagates in the tool. When the stress wave reaches the end of the tool facing the rock to be drilled, the tool penetrates into the rock due to the influence of the wave. Some of the energy of the stress wave may reflect back as a reflected wave, which propagates in the opposite direction in the tool, i.e. towards the impact mechanism. Depending on the situation, the reflected wave may include only a compression stress wave or a tensile stress wave. However, the reflected wave typically includes both tension and compression stress components.

FIG. 1 shows schematically a significantly simplified side view of a rock drilling rig 1. The rock drilling rig 1 includes a moving carrier 2 and a boom 3 at the end of which there is a feed beam 4 provided with a rock drilling machine 8 having an impact mechanism 5 and a rotating mechanism 6. The rock drilling rig 1 of FIG. 1 further has a tool 9, the proximal end 9' of which is coupled to the rock drilling machine 8 and the distal end 9" of which is oriented towards the rock 12 to be drilled. The proximal end 9' of the tool 9 is shown in FIG. 1 schematically by a broken line. The tool 9 of the rock drilling rig 1 of FIG. 1 includes drill rods 10*a*, 10*b* and 10*c* or drill stems 10*a*, 10*b*, 10*c* or drill tubes 10*a*, 10*b*, 10*c* and a drill bit 11 at the distal end 9" of the tool 9. The drill bit 11 may be provided with buttons 11*a*, although other drill bit structures are also possible. In drilling with sectional drill rods, also known as long hole drilling, a number of drill rods depending on the depth of the hole to be drilled are attached between the drill bit 11 and the rock drilling machine 8. The tool 9 may also be supported with guide supports 13 attached to the feed beam 4.

Furthermore the rock drilling rig 1 of FIG. 1 also includes a feed mechanism 7, which is arranged to the feed beam 4, in relation to which the rock drilling machine 8 is movably arranged. During drilling the feed mechanism 7 is arranged to push the rock drilling machine 8 forward on the feed beam 4 and thus to push the drill bit 11 against the rock 12.

It should be appreciated that FIG. 1 shows the rock drilling rig 1 considerably smaller in relation to the structure of the rock drilling machine 8 than what it is in reality. For the sake of clarity, the rock drilling rig 1 of FIG. 1 has only one boom 3, feed beam 4, rock drilling machine 8 and feed mechanism 7, although it is obvious that a rock drilling rig may be provided with a plurality of booms 3 having a feed beam 4, a rock drilling machine 8 and a feed mechanism 7. It is also obvious that the rock drilling machine 8 usually includes flushing means to prevent the drill bit 11 from being blocked. For the sake of clarity, no flushing means are shown in FIG. 1. The drilling machine 8 may be hydraulically operated, but it may also be pneumatically or electrically operated.

The drilling machine may also have a structure other than explained above. For example in down-the-hole-drilling, the impact mechanism is located in the drilling machine at the bottom of the drilling hole next to the drill bit, the drill bit being connected through the drill rods to the rotating mechanism located above the drilling hole. The drilling machine may also be a drilling machine intended for rotary drilling, whereby there is no impact mechanism in the drilling machine.

The impact mechanism 5 may be provided with an impact piston reciprocating under the influence of pressure medium and striking to the tool either directly or through an intermediate piece, such as a drill shank or another kind of adapter, between the tool 9 and the impact piston. Naturally, an impact mechanism of a different structure is also possible. The operation of the impact mechanism 5 may thus also be based on use of electromagnetism or hydraulic pressure without any mechanically reciprocating impact piston and in this context the term impact mechanism refers also to impact devices based on such characteristics.

The stress wave generated by the impact mechanism 5 is delivered along the drill rods 10*a* to 10*c* towards the drill bit 11 at the distal end 9" of the tool 9. When the stress wave meets the drill bit 11, the drill bit 11 and its buttons 11*a* strike the rock 12 to be drilled, thereby causing to the rock 12 a strong stress due to which cracks are formed in the rock 12. Typically, part of the stress wave exerted on or acting on the rock 12 reflects back to the tool 9 and along the tool 9 back towards the impact mechanism 5. During drilling the rotating mechanism 6 transmits continuous rotating force to the tool 9, thus causing the buttons 11*a* of the drill bit 11 to change their position after an impact and to strike a new spot on the rock 12 at the next impact.

FIG. 2 is a graphical representation of a stress wave, wherein the stress wave propagating towards the rock 12 to be drilled is denoted with a reference mark $s_i$ and the stress wave reflected from the rock 12 back to the tool 9 is denoted with a reference mark $s_r$.

FIG. 3 shows schematically a partly cross-sectional side view of a rock breaking system 14 which may be used, for example, in the rock drilling machine 8 of the rock drilling rig 1 of FIG. 1. The rock breaking system 14 of FIG. 3 includes an impact mechanism 5 and a tool 9 connected to the impact mechanism 5. The tool 9 in the rock breaking system 14 of FIG. 3 includes drill rods 10*a*, 10*b* or drill stems 10*a*, 10*b* or drill tubes 10, 10*b* and a drill bit 11 at the distal end 9" of the drill rod 10*b*. The impact mechanism 5 has a frame structure 5' and an impact device 15 arranged to provide impact pulses directed to the tool 9.

In the embodiment of FIG. 3 the impact device 15 has a form of an impact piston but the actual implementation of the impact device 15 and the impact mechanism 5 may vary in many ways. The impact mechanism 5 of FIG. 3 also includes a drill shank 16 to which the proximal end 9' of the tool 9 is fastened, whereby the impact device 15 is arranged to direct the impact to the drill shank 16 and not directly to the tool 9, the drill shank 16 thus forming an intermediate piece between the impact device 15 and the tool 9. The impact mechanism 5 of FIG. 3 further includes an attenuating device 17, which is shown very schematically in FIG. 3 and which is positioned between the drill shank 16 and the impact device 15 and supported to the frame structure 5' of the impact mechanism 5. The function of the attenuating device 17 is to attenuate effects of stresses reflecting back to the tool 9 and the impact mechanism 5 from the rock 12. The attenuating device 17 may also provide positioning of the drill shank 16 at such a point relative to the impact device 15 that the impact provided by the impact device 15 will have an optimal effect on the drill shank 16. The actual implementation of the attenuating device 17 may have, for example, one or more pressure medium operated cylinders.

In the embodiment of FIG. 3, the impact mechanism 5 and the tool 9 coupled to the impact mechanism 5 form the rock breaking system 14, which is subjected to stresses, vibrations or forces during rock breaking. The drill rods or drill stems or drill tubes 10*a*, 10*b* and the drill bit 11 are component of the tools and therefore components of the rock breaking system 14. The drill shank 16 is a component of the impact mechanism 5, the drill shank 16 thus also being a component of the rock breaking system 14.

An implementation of the rock breaking system may, however, vary in many ways. In breaking hammers, which provide another example of the rock breaking device, the rock breaking system includes typically only an impact device, such as an impact piston, and a non-rotating tool, such as a chisel, and the impact provided by the impact device affects straight to the tool.

Depending on the implementation the rock breaking system may be hydraulically, pneumatically or electrically operated or the operation of the rock breaking system may be implemented as a combination of hydraulically, pneumatically and/or electrically operated devices. For the sake of clarity, FIGS. 1 and 3 do not show any pressure medium lines or electrical lines needed for the operation of the rock breaking system, which lines are as such known to the person skilled in the art.

In many embodiments and examples disclosed below the state of remanent magnetization with the predetermined varying magnetization profile is presented to be arranged to the drill shank 16. In addition to the drill shank 16, the component, which may be arranged to the state of permanent magnetization having the predetermined varying magnetization profile in a similar way as disclosed in view of the drill shank may for example be an impact piston of an impact mechanism of the rock breaking system, or a tool of the rock breaking system, such as a rotating tool like a drill stem or a drill rod or a drill tube or a drill bit in a rock drilling machine, or a non-rotating tool like a chisel in a breaking hammer. The component may also be an impact device or an attenuating device disclosed above. Generally, the component of the rock breaking system to be arranged to the state of remanent magnetization having predetermined varying magnetization profile relative to the geometry of the component may be a component that causes impact pulses or transmits impact pulses when assembled in the rock breaking system.

Figure 4:
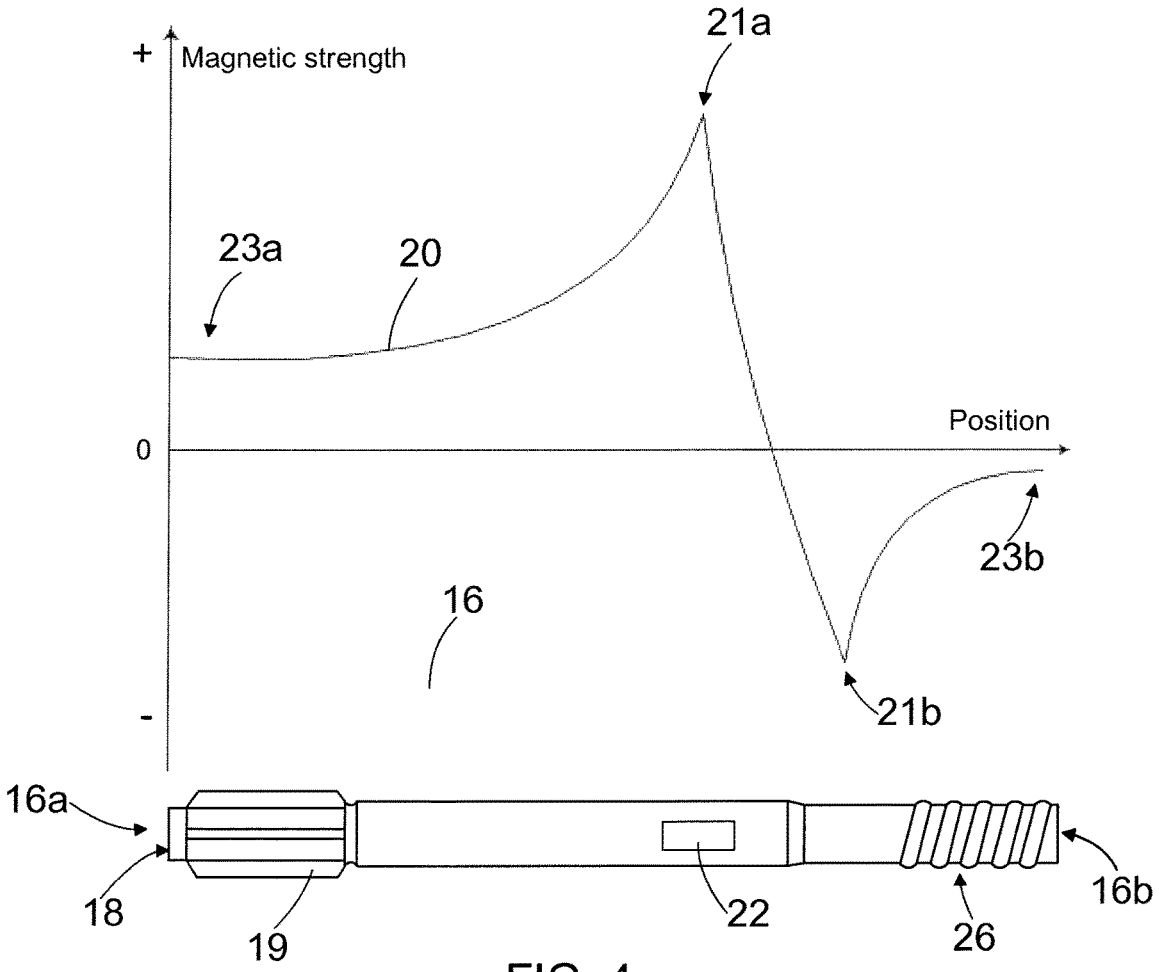
FIG. 4 illustrates a drill shank of the rock breaking system and a predetermined varying magnetization profile of remanent magnetization arranged to the drill shank.

FIG. 4 shows schematically a drill shank 16 having a first end 16*a* to be directed towards the impact device 15 and a second end 16*b* to be directed away from the impact device 15, i.e. towards the tool 9 of the rock breaking system 14. At the first end 16*a* of the drill shank 16 there is an impact surface 18 against which the impact provided by the impact device 15 may be directed to, and splines 19, to which the rotating mechanism 6 is to be attached for rotating the drill shank 16 and the tool 9 connected to the drill shank 16 through the thread 26 in the drill shank 16.

Further FIG. 4 also shows schematically a predetermined magnetization profile 20 of a remanent or persistent magnetization arranged to the drill shank 16. The remanent magnetization of the drill shank 16 has a predetermined varying magnetization profile relative to a geometry of the drill shank 16. The predetermined varying magnetization profile describes a predetermined varying magnetization intensity or magnetic strength in the drill shank 16 relative to the geometry of the drill shank 16.

Generally in the predetermined varying magnetization profile 20 of the remanent magnetization the intensity or the strength of the remanent magnetization, and/or the polarity or the direction of the remanent magnetization, is/are arranged to vary or change along a dimension of the component in a predetermined manner so that a tangent, i.e. a derivative or a rate of change of the profile is not substantially constant in all points of the profile. The varying magnetization profile 20 describes magnetic strength or intensity observed with respect to a fixed reference, for example, at a constant distance from a surface of the component either inwards or outwards of the component, at a constant distance from a central point or axis of the component, at a constant distance from a part the component is attached to, coupled to or in contact with.

The variation of the magnetization profile may also be described such that the varying magnetization profile has an alternating shape or an uneven shape or that the profile is non-uniform or non-monotonous. The varying magnetization profile means that the magnetic intensity or strength has a non-constant value along a dimension of the component, has a non-uniform or irregular shape, may alternate, lacks an overall trend, may contain one or more discontinuities, has at least one peak and/or has a derivative that changes sign and is zero at least at one point of the profile.

In the embodiment of FIG. 4, the graph 20 describes a magnetic strength of the remanent magnetization arranged to the drill shank 16 relative to or in the longitudinal direction of the drill shank 16. The vertical axis indicates the magnetic strength and polarity or direction of the remanent magnetization arranged to the drill shank 16 and the horizontal axis indicates the position in the drill shank 16, or in other words, a distance from the first end 16*a* of the drill shank 16 towards the second end 16*b* of the drill shank 16.

In FIG. 4 the predetermined varying magnetization profile 20 of the remanent magnetization arranged to the drill shank 16 includes two peak points 21*a*, 21*b* located at a portion of the drill shank 16 remaining between the first end 16*a* and the second end 16*b* of the drill shank 16, i.e. at a distance away from both the first end 16*a* and the second end 16*b* of the drill shank 16. The first peak point 21*a* has a positively valued magnetic strength and the second peak point 21*b* has a negatively valued magnetic strength. The profile 20 at the second peak point 21*b* thus has a polarity or direction opposite to that of the profile 20 at the first peak point 21*a*. An absolute value of the magnetic strength of the second peak point 21*b* having the negatively valued magnetic strength is smaller than an absolute value of the magnetic strength of the first peak point 21*a* having the positively valued magnetic strength.

In the embodiment of FIG. 4, the predetermined varying magnetization profile 20 of the remanent magnetization arranged to the drill shank 16 includes two peak points 21*a*, 21*b* but the number of the peak points, as well as their peak values and polarities in the predetermined varying magnetization profile 20 may differ in the different embodiments.

Generally the predetermined varying magnetization profile of the component may have at least one peak point at which a variable describing the profile of the remanent magnetization has a real value or an absolute value that exceeds real values or absolute values of the variable at points of the profile neighbouring the peak point.

According to an embodiment, the predetermined magnetization profile 20 of the remanent magnetization arranged to the drill shank 16 may include more than one peak point, i.e. two or more peak points. In that case it may be said that the variable describing the magnetization profile 20 of the remanent magnetization has two or more peak points at which a real value or an absolute value of the variable describing the magnetization profile 20 exceeds real values or absolute values of the variable at points of the profile neighbouring the specific peak point.

According to an embodiment, the predetermined magnetization profile 20 of the remanent magnetization arranged to the drill shank 16 includes only one peak point. In that case it may be said that the predetermined magnetization profile of the component includes a single peak point, at which a variable describing the profile of the remanent magnetization has a real value or an absolute value that exceeds a real value or an absolute value of the variable at any other point of the profile.

When the predetermined varying magnetization profile 20 of the remanent magnetization arranged to the drill shank 16 includes at least one peak point, a magnetic sensor 22 may, for example, be arranged at the drill shank 16 at the point of the at least one peak point of the predetermined varying magnetization profile for measuring magnetoelastic changes caused by stress waves in the drill shank 16. At the peak points of the remanent magnetization the magnetoelastic changes of the drill shank 16 caused by stress waves are the most detectable, whereby when the sensor 22 is arranged at the drill shank 16 at the point of the at least one peak point 21 of the predetermined magnetization profile 20, the magnetoelastic changes of the drill shank 16 caused by stress waves can be measured easily.

If the predetermined varying magnetization profile of the remanent magnetization of the component includes more than one peak point, the magnetic sensor 22 is according to an embodiment located in the component at that peak point where the variable describing the profile of the remanent magnetization has the real value or the absolute value that exceeds the real value or the absolute value of the variable at any other point of the profile, i.e. at the point where the magnetic strength of the magnetization is the most intensive.

When the predetermined varying magnetization profile 20 of the state of persistent magnetization arranged to the drill shank 16 includes more than one peak point, a magnetic sensor 22 may according to an embodiment be arranged at the drill shank 16 at each peak point for measuring magnetoelastic changes caused by stress waves in the drill shank 16. This may further enhance the accuracy of the measurement.

According to an embodiment, one sensor or more sensors may be placed at a position where the magnetic strength in the component is most suitable for measurement purposes. This does not necessarily need to be any peak point. A suitable position may also be one where the magnetic strength is low or substantially close to zero. It is also possible to have a number of sensors at the peak point or peak points and another number of sensors at non-peak points.

Further, if the component is arranged to move with respect to the sensor, the change of the magnetic strength at the sensor as a function of the movement and position of the component can be used as a source of measurement.

Furthermore, when the component of the rock breaking system, at which the magnetoelastic changes caused by the stress waves are measured, is arranged into a state of remanent magnetization, the rock breaking system does not need to be provided with any kind of instruments providing the specific component into a magnetic state or subjecting the specific component to an external magnetic field simultaneously during the measurement of the stress waves. This simplifies the instrumentation for the stress wave measurement and does not cause disturbances originating from the instruments subjecting the specific component to the external magnetic field simultaneously during the measurement of the stress waves.

As presented in the embodiment of the predetermined varying magnetization profile 20 disclosed in FIG. 4, in addition to the peak points 21*a*, 21*b* and their neighbourhood which together provide a varying portions in the profile 20, the predetermined varying magnetization profile 20 disclosed in FIG. 4 includes also flat portions 23*a*, 23*b*, i.e. the first flat portion 23*a* and the second flat portion 23*b*, having a substantially constant magnetic strength. In the embodiment of FIG. 4 the first flat portion 23*a* is arranged next to the first end 16*a* of the drill shank 16 and the second flat portion 23*b* is arranged next to the second end 16*b* of the drill shank 16. If the magnetic strength of the first flat portion 23*a* at the first end 16*a* of the drill shank 16 and the magnetic strength of the second flat portion 23*b* at the second end 16*b* of the drill shank 16 are set to substantially close to zero, i.e. if they are demagnetized, it has an advantageous effect that impurities do not adhere so easily to the substantially magnetically neutral impact surface 18 or splines 19 or the second end 16*b* of the drill shank 16, which could cause problems in an operation of the rock drilling machine 8. In other words, the component may include portions or parts, in which portions or parts there is no magnetization or which portions or parts are demagnetized so that the magnetic strength in the predetermined varying magnetization profile is zero or substantially close to zero at these parts or portions.

In the embodiment disclosed in FIG. 4, the state of remanent magnetization of the drill shank 16 has the predetermined varying magnetization profile in a longitudinal direction of the drill shank 16, i.e. relative to a longitudinal geometry of the component. Alternatively the drill shank 16 may be arranged to the state of remanent magnetization in such a way that the state of remanent magnetization may have the predetermined varying magnetization profile in a direction transversal to a longitudinal direction of the drill shank 16, i.e. in a direction transversal to the direction of the drill shank 16, such as in a radial direction of the drill shank 16, or in a rotational direction of the drill shank 16, or in a circular direction of the drill shank 16, or in a circumferential direction of the drill shank 16. This means that the drill shank 16 may have a predetermined varying magnetization profile relative to a geometry transversal to the longitudinal geometry of the drill shank 16, such as relative to a radial geometry, or relative to a rotational geometry of the drill shank 16.

The state of remanent magnetization of the component is based on the hysteresis phenomenon taking place in the component subjected to an effect of a magnetic field. Hysteresis phenomenon arises from interactions between imperfections in a component material and a movement of magnetic domain walls. When the component material is subjected to the applied magnetic field, the movement of the magnetic domain wall motion is hindered due to the imperfections in the material such as nonmagnetic material impurities and grain boundaries. This leads to irreversible changes in the magnetization of the component. Once saturation magnetization is reached the magnetic field external to the component is reduced to zero, but the magnetic flux density in the component does not go to zero but lags behind, causing a remanence or remanent magnetization remaining in the component. Remanence is the magnetic density which remains in the component material after the external magnetic field is removed.

Figure 5:
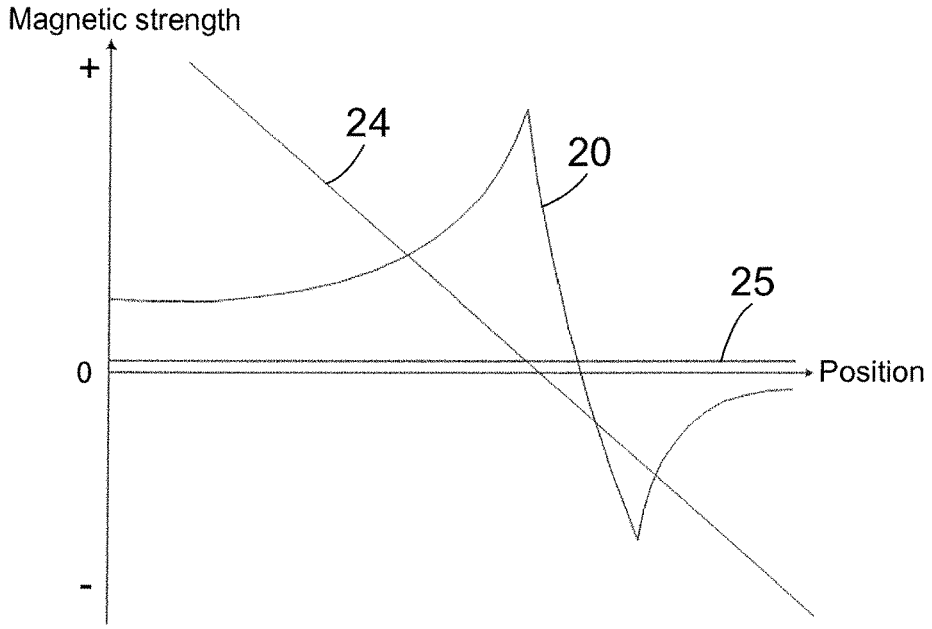
FIG. 5 is a comparison of the predetermined varying magnetization profile of FIG. 4 to a prior art magnetization profile.

FIG. 5 discloses schematically a comparison between the predetermined varying magnetization profile 20 according to a solution disclosed herein and a prior art magnetization 24 being provided by using electromagnet in a prior art known manner. A substantially similar magnetization 24 will result from exposure to an external magnetic field by other prior art means, such as permanent magnets or other magnetic field generation devices. The magnetization 24 provided by using electromagnet in the prior art known manner has a shape having a substantially constantly decreasing magnetic strength, therefore having a constant trend and a substantially constant rate of change, lacking peaks, discontinuities and non-symmetric characteristics, for example. The magnetization 24 of prior art thus does not provide the characteristics of the predetermined varying magnetization profile 20 as disclosed above, wherefore magnetization 24 may not be suitable for accurate measurement or other uses of the magnetization profile as disclosed later.

At this point it may be noticed that if the magnetization 24 of a component is measured with a sufficient accuracy, the measured magnetic strength may show some random peaking or profile characteristics due to material properties, impurities and randomness in material and measurements, but these possible random characteristics are not predetermined and they also vary across individual specimens of components. In addition, the level or value of them is usually very low, whereas in the predetermined varying magnetization profile 20 any changes in the level or strength of magnetization are clearly observable. According to an embodiment these changes may be several dozens of per cents of any reference or base level of the magnetization. The reference or the base level of the magnetization may for example provided by the first flat portions 23*a* or the second flat portion 23*b* of the profile 20.

Further FIG. 5 discloses a magnetization profile 25 presenting a state of magnetization, wherein the component is intentionally arranged to a non-magnetic state. In the component arranged to the non-magnetic state the magnetic strength of the magnetization profile 25 is substantially close to zero and substantially flat along the geometry, in this case along the longitudinal direction, of the component.

Figure 6:
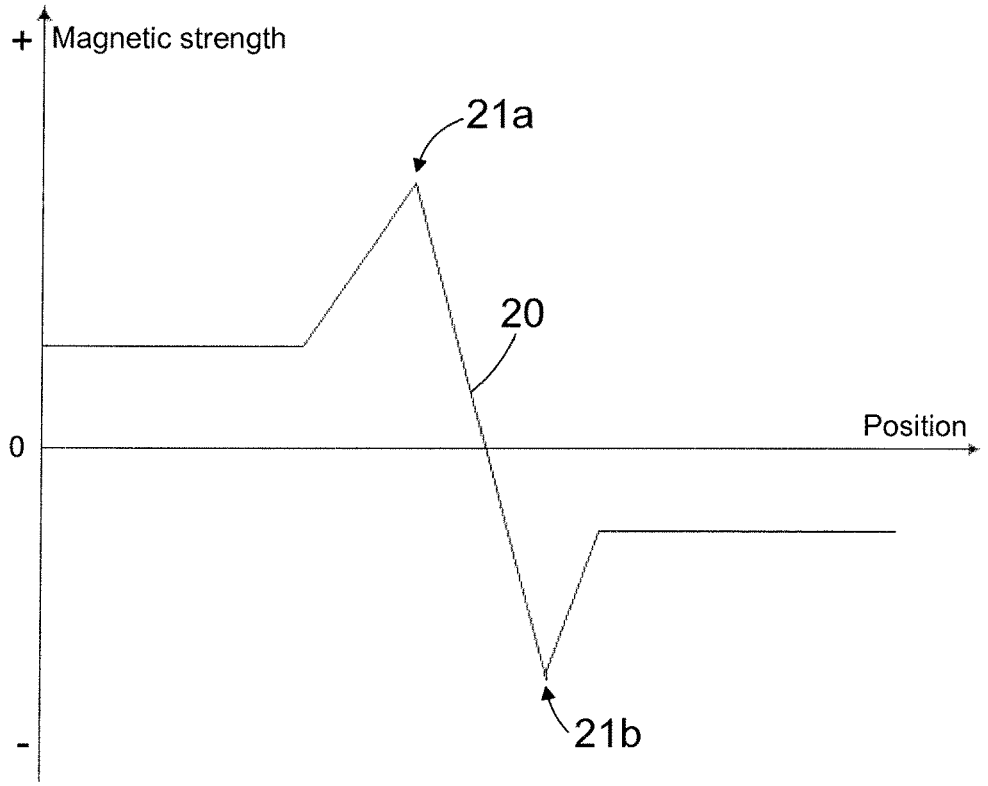
FIG. 6 is another predetermined varying magnetization profile of remanent magnetization arranged to the drill shank.

FIG. 6 shows schematically a second embodiment of a remanent magnetization with a predetermined varying magnetization profile 20 which may be arranged to the drill shank 16, for example. The general shape of the predetermined magnetization profile 20 of the remanent magnetization of FIG. 6 is substantially the same as in the FIG. 4 but the transitions between the peak points 21*a*, 21*b* and the flat portions 23*a*, 23*b* are more abrupt in the embodiment of FIG. 6.

The state of permanent magnetization may be described with a variety of variables describing the magnetization. The variable describing the predetermined varying magnetization profile of the permanent magnetization or the magnetic strength of the predetermined varying magnetization profile of the permanent magnetization may describe a magnetic field of the component, strength of a magnetic field of the component, direction of a magnetic field of the component, a magnetic flux of the magnetic field of the component, a permeability of the component or a magnetic inductivity of the component or some another quantity of magnetism remaining in the component, or a combination of several quantities of magnetism.

According to an embodiment of the component, the component to be arranged to the state of permanent magnetization with predetermined varying magnetization profile may include portions having different magnetic properties. In that case the component may also include portions which cannot be magnetized at all or will not be magnetized at all. The portions of the component having different magnetic properties may exist in a longitudinal direction of the component, in the direction transversal to the longitudinal direction of the component, such as in a radial direction of the component, or in the rotational direction of the component.

Figure 7:
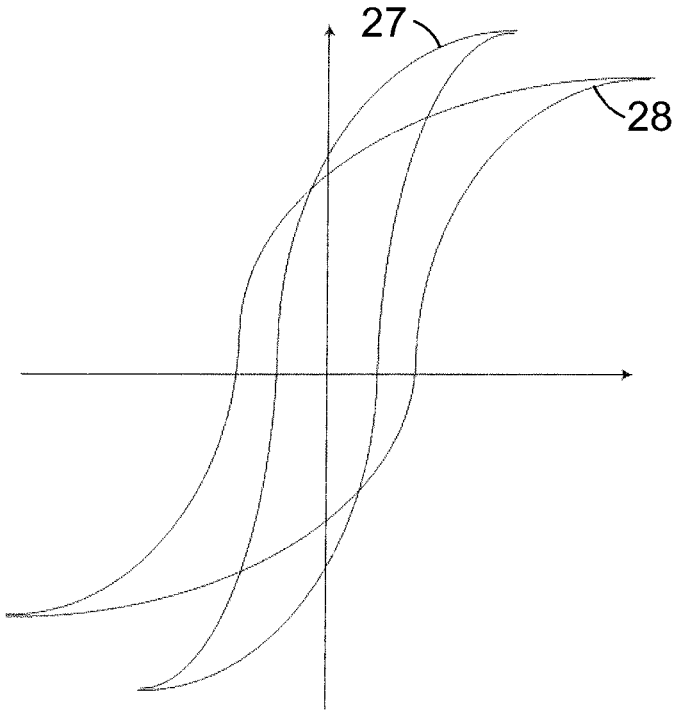
FIG. 7 is a schematic representation of a hysteresis curve.

The portions of the component having different magnetic properties refer to the portions of the component made of materials having different magnetic properties. Generally the materials having different magnetic properties are divided to soft magnetic materials and hard magnetic materials. The shape of the hysteresis curve, where the internal magnetization of the material is given as a function of an external magnetic field, of the material reveals whether the material is magnetically soft or hard. A narrow hysteresis curve is typical for soft magnetic materials and hard magnetic materials have a wider hysteresis curve. Coercivity is the magnetic field strength which is required to reduce the magnetization of a magnetized material to zero. FIG. 7 discloses a schematic example of a hysteresis curve 27 for a soft magnetic material and a hysteresis curve 28 for a hard magnetic material, the horizontal axis describing the external magnetic field strength and the vertical axis describing the internal magnetization of the material.

The magnetically hard material is material the magnetic state of which is very hard to change, but on the other hand when the magnetic state of the magnetically hard material has been changed from the non-magnetic state to the magnetic state, the magnetic state of the material remains substantially constant.

Hard magnets, also referred to as permanent magnets, are magnetic materials that retain their magnetism after being magnetized. In other words changing their magnetization is difficult and laborious without strong external magnetic fields. Practically, this means materials that have an intrinsic coercivity of greater than ~10 kA/m. For soft magnetic materials coercivity is under 1 kA/m. A typical coercivity for materials used in rock breaking system components in this invention is in the order of ~2 kA/m or larger which means that rock breaking system component materials in this invention are somewhere between soft and hard magnetic materials. That is, their magnetization can be converted to correspond a desired predetermined profile and the predetermined profile is preserved for long periods of time fields in the form of remanent magnetization in the material, and regardless of relatively weak external magnetic fields or other external factors, such as the impacting by the rock drilling machine.

The magnetic properties of the component material may be affected to with some different factors. One of these factors may be a heat treatment, for example quench and tempering or case hardening. Another factor is the affect on the composition and/or alloying of the component material, carbon concentration being the most important compositional factor. One other factor is a grain size of the component material. One factor is a surface treatment or coating with magnetically hard substance. Yet another factor is cold working of the component material, for example forging or otherwise subjecting the material to impacts.

According to an embodiment of the component, at least part of the component is at least partly made of magnetically hard material or made of material(s) magnetically harder than other parts of the component.

According to an embodiment of the component, at least part of the component is coated with a material having magnetic properties differing from magnetic properties of the component. According to an embodiment like that part of the surface of the component may include a magnetic stripe.

According to an embodiment of the component, at least part of the component has a geometry affecting on a formation of the predetermined varying magnetization profile of permanent magnetization of the component in response to the magnetization of the component. The predetermined varying magnetization profile is thus at least partly provided by the geometry of the component when the component is subjected to an effect of the magnetization or that changes in the profile of the predetermined varying magnetization are arranged to correspond to changes in the geometry of the component. Features of the component that may be used in controlling of a formation of the predetermined varying magnetization profile in the component are for example grooves, cavities and variation of a cross-sectional shape or area of the component as well as a surface roughening of the component.

The remanent magnetization with the predetermined varying magnetization profile may for example be provided to the component by applying one or more magnetization pulses to the drill shank 16.

According to an embodiment the predetermined varying magnetization profile is provided to the component by a magnetization coil. In this embodiment a number of current pulses is applied to the magnetization coil which is arranged close to, such as surrounding, the component to be magnetized with the predetermined varying magnetization profile. The magnetization coil and the component to be magnetized are moved with respect to each other between the successive current pulses. The magnetized portion of the component or the peak point in the predetermined varying magnetization profile may be broadened by applying current pulses of same direction or narrowed by applying current pulses of different direction. The magnitude and direction of the successive current pulses is set, on the basis of the mutual position between the component to be magnetized and the magnetization coil, for providing the desired predetermined varying magnetization profile. The magnetization coil may be a part that is fastened to the rock breaking system or a part of separate magnetization coil. Other arrangements for providing the predetermined magnetization profile may also be applied to.

Furthermore, in order to provide a desired predetermined varying magnetization profile in the component it may also be varied other factors in the magnetization process, such as speed of movement of coil or component, number of coils and their relative displacement and dimension of coil(s) and their variation depending on the desired profile.

According to an embodiment the predetermined varying magnetization profile is provided to the component by using a ring-shaped permanent magnet. In this embodiment the ring-shaped permanent magnet is set around the component to be magnetized and a magnetic flux of the permanent magnet is connected to the component to be magnetized when the permanent magnet and the component are at a desired position relative to each other, whereby the desired portion in the component is to be magnetized.

According to an embodiment the predetermined varying magnetization profile is provided to the component by using a button-shaped permanent magnet. In this embodiment the button-shaped permanent magnet is moved from the side of component to be magnetized close to the outer surface of the component. The magnetic flux of the permanent magnet is connected to the component to be magnetized when the permanent magnet and the component are in a predetermined position relative to each other, and the permanent magnet is rotated around the component to be magnetized close to the outer surface of the component.

According to an embodiment the component to be magnetized is located to a shipping container which also includes means for magnetizing the component into the state of remanent magnetization with the predetermined varying magnetization profile. In other words, there is a shipping container comprising a protective casing and a component as disclosed in this description, wherein the protective casing includes magnetization means for magnetizing the component into the state of remanent magnetization with the predetermined varying magnetization profile.

Figure 8:
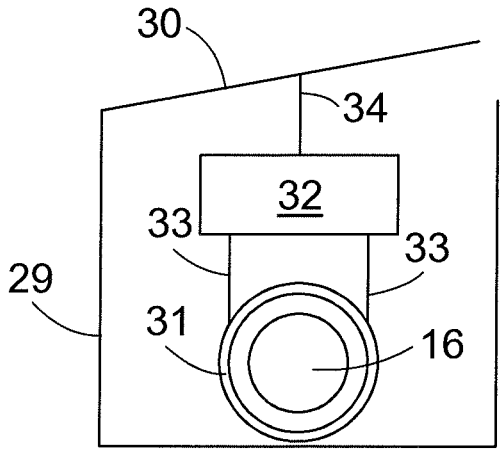
FIG. 8 is a schematic view of a container, which may be used in shipping of a component of the rock breaking system.

According to an embodiment the magnetization means are arranged to magnetize the component into the state of remanent magnetization in response to an opening of the shipping container. The shipping container includes a permanent magnet which is arranged to rotate around the component in the shipping container in response to an opening of the shipping container, whereby the component is magnetized with the predetermined varying magnetization profile. According to an embodiment the shipping container includes a magnetization coil and electronics providing a current pulse to the magnetization coil in response to an opening of the shipping container, whereby the component is magnetized with the predetermined varying magnetization profile. FIG. 8 discloses a schematic cross-sectional end view of a container 29 with a cover 30 and containing a drill shank 16, a magnetization coil 31 around the drill shank 16 and electronics 32 connected to the magnetization coil 31 with wiring 33 and to the cover 30 of the container 29 with means 34, the electronics 32 providing a current pulse to the magnetization coil 31 in response to an opening of the cover 30 of the container 29.

According to an embodiment of the shipping container the protective casing includes means for maintaining the magnetization of the component in a state of remanent magnetization with the predetermined varying magnetization profile. In this embodiment the component is thus arranged in the state of remanent magnetization with the predetermined varying magnetization profile before placing the component into the shipping container and the container includes means for maintaining the magnetization of the component in a state of remanent magnetization with the predetermined varying magnetization profile. That kind of protective measure may for example be a Faraday cage solution, such as a metal lining or mesh in the container or around the component.

In a method for magnetizing a component for a rock breaking system, wherein the component is magnetized into a state of remanent magnetization, the component is thus magnetized into the state of remanent magnetization having a predetermined varying magnetization profile relative to a geometry of the component, the varying magnetization profile describing a varying magnetization intensity in the component relative to the geometry of the component.

According to an embodiment of the method, the component is magnetized into the state of remanent magnetization having at least one peak point in the predetermined varying magnetization profile, at which peak point of the profile a variable describing the profile of the remanent magnetization has an absolute value that exceeds absolute values of the variable at points of the profile neighbouring the peak point.

According to an embodiment of the method the component is magnetized into the state of remanent magnetization by subjecting the component to an effect of magnetization at a limited portion of the component.

The component magnetized into the state of remanent magnetization having the predetermined varying magnetization profile as disclosed herein has several possible applications, some of them being listed below.

According to an embodiment the magnetization of the component is utilized for the measurement of the stress wave and the characteristics thereof. The measurement information may be used for example for controlling one or more operations in the rock breaking system or the rock drilling machine, such as a percussion power, a rotation rate, a feeding power or a combination thereof. The measurement information may also be processed to represent additional information or parameters being not directly related to stresses appearing in the drilling. This additional information may for example relate to a kind of rock to be drilled.

According to an embodiment the magnetization of the component is utilized for a measurement of a position of the component. The position measurement may be based on for example on the movement of the component and its magnetic profile with respect to at least one measurement sensor.

According to an embodiment the magnetization of the component is utilized for a measurement of a rotational speed of the component. The rotational speed measurement may be based on for example rotation of the component and its magnetic profile with respect to at least one measurement sensor.

According to an embodiment the magnetization of the component is utilized for an identification or a measurement of an angular position of the component. The identification or the measurement of the angular position of the component may be based on for example rotation of the component and its magnetic profile with respect to at least one measurement sensor.

According to an embodiment the magnetization of the component is utilized for an identification of the component. The identification information of the component is coded in the shape or amplitude of the magnetic profile, read with a special reader or upon moving the component past a sensor. As a specific example it may be presented for example a drill which has a magnetization profile along a full length of the drill rod and includes a coding in the magnetization as disclosed above, whereby a sensor at a suction head or a guide ring of the rock drilling machine may be applied to read the coded information in the magnetization profile of the drill rod as the drill rod moves past the sensor. The coding may be used for example for verification or authentication of the component or the manufacturer thereof or in a follow-up of a life time estimation of the component.

According to an embodiment the magnetization of the component is utilized for a measurement of a straightness of a drilling hole or an orientation of a drilling tool based on magnetic references in the drilling tool. For example the drill rods may have in specific parts magnetic markings or profiles that can be used to determine an orientation, a position or an angular position of the drill rods with respect to each other and a sensing element, which may be for example in a flushing channel of the drill rod or slid through a flushing hole during measurement.

According to an embodiment the magnetization of the component is utilized for a calibration or a reset of a measurement. The measurement is calibrated or reset or is known to be at a fixed point based on a sensor reaching a specific point on a component and its magnetic profile.

In the examples presented above the component disclosed was a drill shank 16. However, all the different embodiments presented in this description are as well applicable for any other component of the rock breaking system, such as the tool 9, the drill rods 10*a*, 10*b*, 10*c* or drill stems 10*a*, 10*b*, 10*c* or drill tubes 10*a*, 10*b*, 10*c*, the drill bit 11, the impact device 15, the attenuating device 17, a chisel or any gears or sleeves used in the rock breaking system.

Although the present embodiment(s) has been described in relation to particular aspects thereof, many other variations and modifications and other uses will become apparent to those skilled in the art. It is preferred therefore, that the present embodiment(s) be limited not by the specific disclosure herein, but only by the appended claims.

What is claimed is:

1. A component for a rock breaking system, the component being magnetized into a state of remanent magnetization, the remanent magnetization having a predetermined varying magnetization profile in at least one of a longitudinal direction of the component, a radial direction of the component, a rotational direction of the component, a direction transversal to a longitudinal direction of the component, a circular direction of the component, and a circumferential direction of the component, the varying magnetization profile describing a varying magnetization intensity in the component relative to a geometry of the component, wherein the rock breaking system includes an impact mechanism having an impact device to provide impact pulses, the component being one of an impact device for causing impact pulses, a component transmitting impact pulses and a component being subjected to impact pulses when assembled in the rock breaking system, and a sensor arranged at the component for measuring magnetoelastic changes caused by stress waves in the component.

2. The component as claimed in claim 1, wherein the predetermined varying magnetization profile has at least one flat part and at least one varying part.

3. The component as claimed in claim 1, wherein the predetermined varying magnetization profile of the component includes at least one peak point at which a variable describing the profile of the remanent magnetization has an absolute value that exceeds absolute values of the variable at points of the profile neighbouring the at least one peak point.

4. The component as claimed in claim 3, wherein the at least one peak point of the predetermined varying magnetization profile of the component is located at a portion of the component remaining between extreme ends of the component.

5. The component as claimed in claim 1, wherein the predetermined varying magnetization profile of the component includes at least two peak points, at least one peak point having an opposite polarity than the other peak points.

6. The component as claimed in claim 1, wherein at least one part of the component is made of magnetically hard material.

7. The component as claimed in claim 1, wherein at least part of the component is coated with a coating material affecting on a formation of the predetermined varying magnetization profile in the component.

8. The component as claimed in claim 1, wherein changes in the profile of the predetermined varying magnetization profile are arranged to correspond to changes in the geometry of the component.

9. The component as claimed in claim 1, wherein the component is at least one of a drill shank of an impact mechanism of the rock breaking system, an impact piston of the impact mechanism of the rock breaking system and a tool of the rock breaking system.

10. The component as claimed in claim 1, wherein the rock breaking system is part of a rock breaking device that is one of a rock drilling machine and a breaking hammer.

11. The component as claimed in claim 1, wherein at least one part of the component is made of material magnetically harder than material of other parts of the component.

12. A method for magnetizing a component of a rock breaking system in a rock breaking device, comprising magnetizing the component into a state of remanent magnetization having a predetermined varying magnetization profile in at least one of a longitudinal direction of the component, a radial direction of the component, a rotational direction of the component, a direction transversal to a longitudinal direction of the component, a circular direction of the component, and a circumferential direction of the component, the predetermined varying magnetization profile describing a varying magnetization intensity in the component relative to the geometry of the component, wherein the rock breaking system includes an impact mechanism having an impact device to provide impact pulses, the component being one of an impact device for causing impact pulses, a component transmitting impact pulses and a component being subjected to impact pulses when assembled in the rock breaking system, and a sensor arranged at the component for measuring magnetoelastic changes caused by stress waves in the component.

13. The method as claimed in claim 12, wherein the predetermined varying magnetization profile has at least one peak point, at which peak point of the profile a variable describing the profile of the remanent magnetization has an absolute value that exceeds absolute values of the variable at points of the profile neighbouring the at least one peak point.

14. A rock breaking system comprising:

a component magnetized into a state of remanent magnetization, wherein the remanent magnetization of the component has a predetermined varying magnetization profile in at least one of a longitudinal direction of the component, a radial direction of the component, a rotational direction of the component, a direction transversal to a longitudinal direction of the component, a circular direction of the component, and a circumferential direction of the component, the varying magnetization profile describing a varying magnetization intensity in the component relative to a geometry of the component;

an impact mechanism including an impact device arranged to provide impact pulses, the component being one of an impact device for causing impact pulses, a component transmitting impact pulses and a component being subjected to impact pulses when assembled in the rock breaking system; and a sensor arranged at the component for measuring magnetoelastic changes caused by stress waves in the component.

15. The rock breaking system of claim 14, wherein the component is at least one of a drill shank of an impact mechanism of the rock breaking system, an impact piston of the impact mechanism and a tool of the rock breaking system.

16. The rock breaking system of claim 14, wherein the rock breaking system is part of a rock breaking device that is one of a rock drilling machine and a breaking hammer.

* * * * *